US005860336A

United States Patent [19]

Chen

[11] Patent Number: 5,860,336

[45] Date of Patent: Jan. 19, 1999

[54] ADJUSTABLE WRENCH

[76] Inventor: Chun Chiung Chen, No. 45, Lane 25, Kuo Chung 1st Road, Da Li City, Taichung Hsien, Taiwan

[21] Appl. No.: 871,421

[22] Filed: Jun. 9, 1997

[51] Int. Cl.[6] ..... B25B 13/16

[52] U.S. Cl. ..... 81/170

[58] Field of Search ..... 81/164, 170, 175, 81/155, 166, 168

[56] References Cited

U.S. PATENT DOCUMENTS 666,950 1/1901 Wirl ..... 81/164

3,046,821 7/1962 Legris ..... 81/164

*Primary Examiner*—James G. Smith

*Assistant Examiner*—Banjamin M. Halpern

[57] ABSTRACT

An adjustable wrench includes a head formed on one end of a tube and having an opening for slidably receiving an engaging member. The tube has a bore communicating with the opening for rotatably and slidably receiving a rod. The rod is threadedly engaged with the head for moving the engaging member toward and away from the tube for allowing the engaging member to engage with fasteners of different sizes. A handle is secured to the rod for rotating the rod and for moving the engaging member toward and away from the fastener.

8 Claims, 5 Drawing Sheets

ADJUSTABLE WRENCH

BACKGROUND OF THE INVENTION

1. Field of the Invention

The present invention relates to a wrench, and more particularly to an adjustable wrench.

2. Description of the Prior Art

Typical wrenches each includes a fixed structure which is good for driving a fastener of a particular size only, such that the user have to buy a lot of wrenches for driving various kinds of fasteners. Typical adjustable wrenches comprise a movable jaw movable toward the fixed jaw for engaging with a fastener. However, the movable jaw may be easily damaged after use.

The present invention has arisen to mitigate and/or obviate the afore-described disadvantages of the conventional adjustable wrenches.

SUMMARY OF THE INVENTION

The primary objective of the present invention is to provide an adjustable wrench which includes a solid structure for engaging with and for driving the fasteners.

In accordance with one aspect of the invention, there is provided an adjustable wrench comprising a tube including a first end, a head provided on the first end of the tube and including an opening and including a first engaging surface for engaging with a fastener, an engaging member slidably engaged in the opening of the head and adapted to be moved toward and away from the first engaging surface of the head, the engaging member including a second engaging surface for engaging with the fastener, and means for moving the engaging member toward the fastener for allowing the engaging member to engage with fasteners of different sizes.

The tube includes a bore communicating with the opening and includes a second end, the head includes an inner thread, the moving means includes a rod rotatably and slidably engaged in the bore of the tube, the rod includes a first end for engaging with the engaging member and includes an outer thread for threadedly engaging with the inner thread of the head and for allowing the rod to move the engaging member along the opening when the rod is rotated. The rod includes a handle secured to the second end for rotating the rod and for moving the engaging member toward and away from the fastener.

The moving means includes a slide slidably engaged in the opening and having a third engaging surface, the engaging member further includes a fourth engaging surface, the second engaging surface and the fourth engaging surface of the engaging member are selectively provided for engaging with the fastener, the moving means further includes means for coupling the slide and the engaging member together.

The slide and the engaging member each includes a bottom portion having a cavity, the coupling means includes a V-shaped resilient blade having two ends for engaging with the cavities of the slide and the engaging member for coupling the slide and the engaging member together.

A positioning means may be provided for positioning the engaging member in place and for allowing the engaging member to be disengaged from the opening. The positioning means includes a cover secured to the head and having a recess, a cap slidably engaged in the cover and adapted to be moved inward and outward of the cover, and means for biasing the cap outward of the cover to engage with the engaging member and for positioning the engaging member in place.

The third engaging surface of the slide includes a middle portion having at least one first tooth, the fourth engaging surface of the engaging member includes a middle portion having at least one second tooth for engaging with the at least one first tooth.

The head includes a block secured in the opening and disposed close to the tube, the inner thread is formed in the block for engaging with the outer thread of the rod.

The slide includes a channel, the tube includes a bore communicating with the opening, the head includes an inner thread, the moving means includes a rod rotatably and slidably engaged in the bore of the tube, the rod includes a first end having a disc for engaging with channel and includes an outer thread for threadedly engaging with the inner thread of the head and for allowing the rod to move the engaging member along the opening when the rod is rotated.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
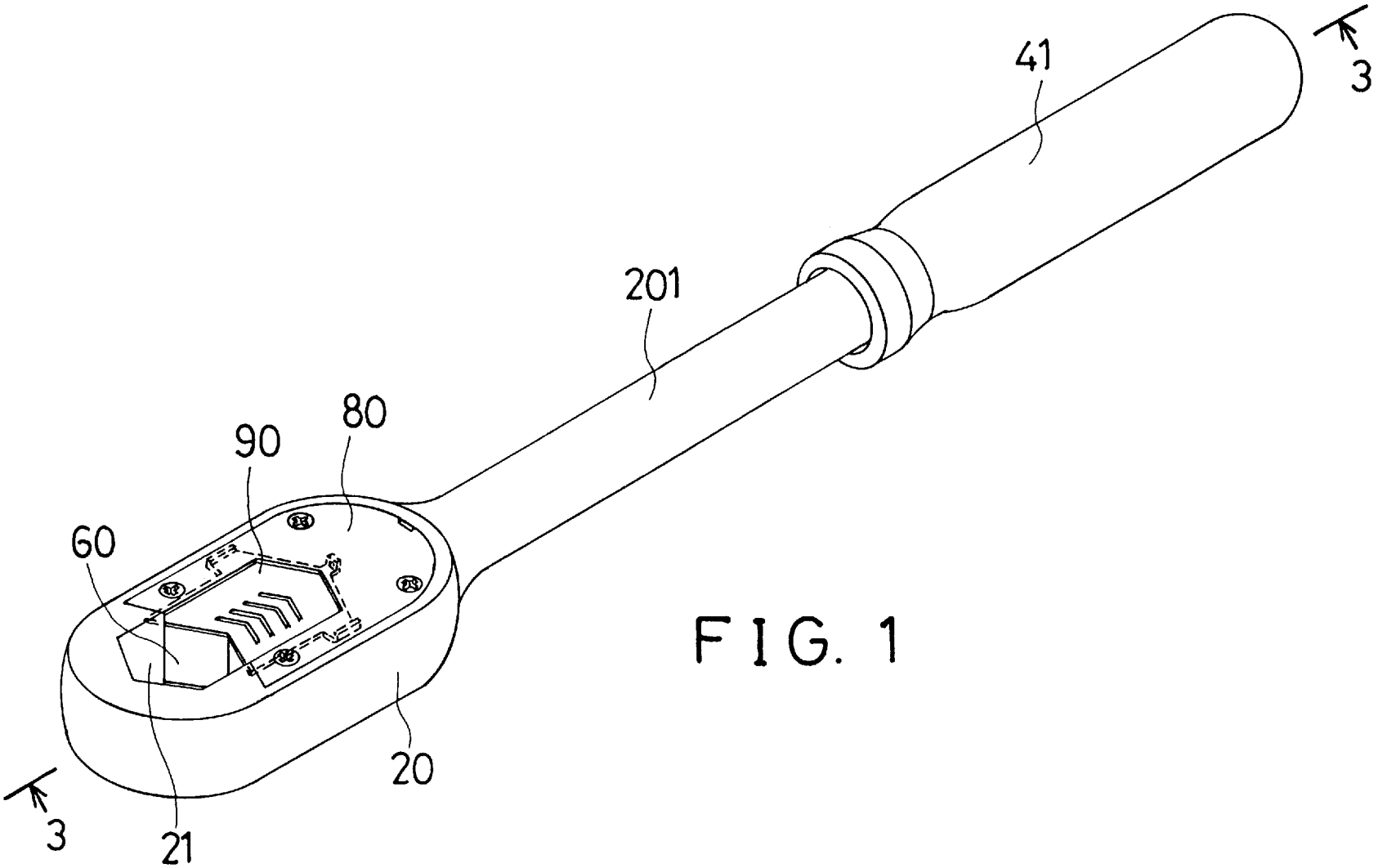
FIG. 1 is a perspective view of an adjustable wrench in accordance with the present invention.
Figure 2:
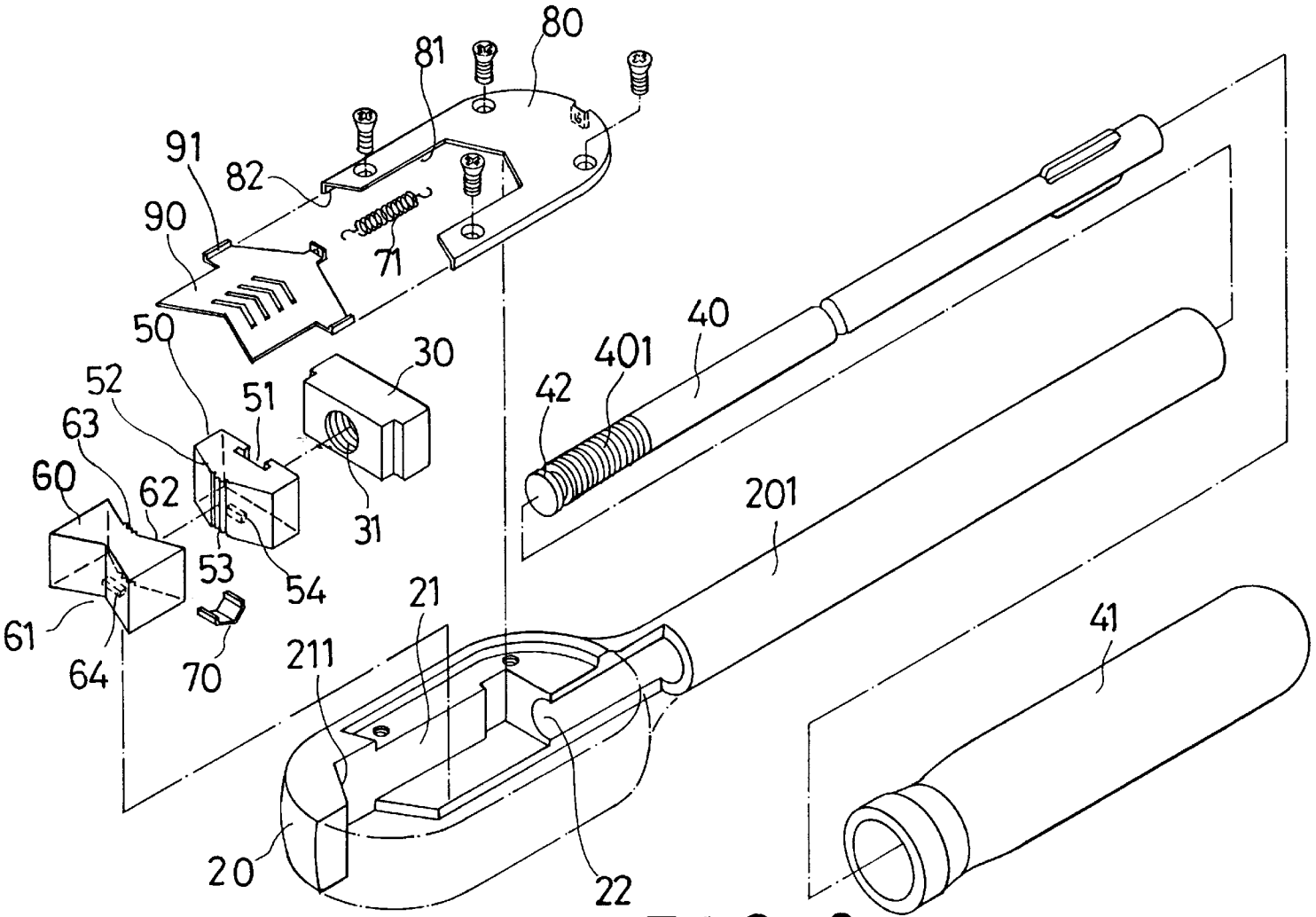
FIG. 2 is an exploded view of the wrench.
Figure 3:
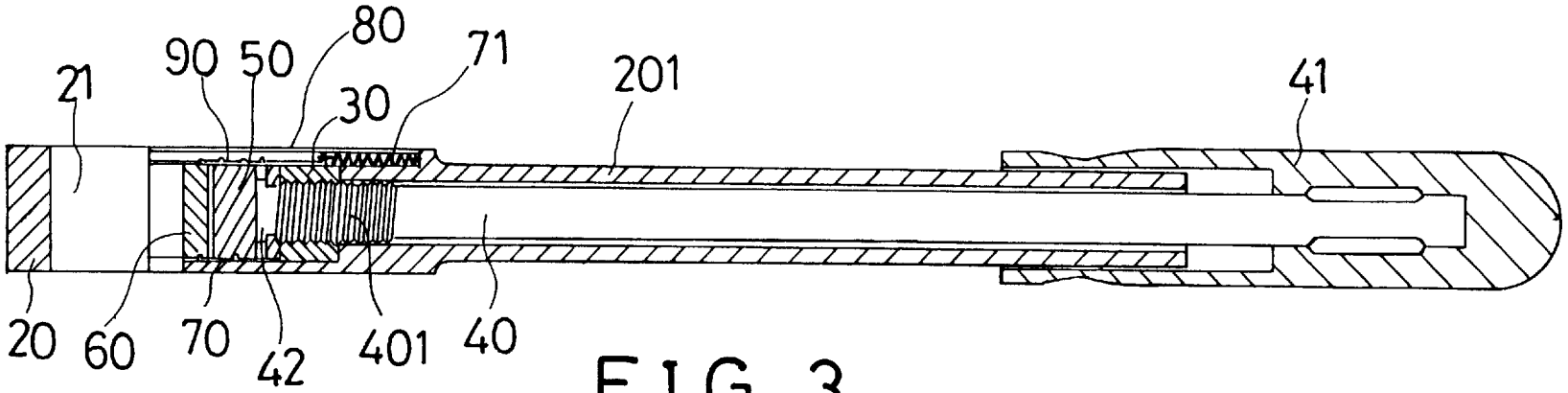
FIG. 3 is a cross sectional view taken along lines 3—3 of FIG. 1.

Referring to the drawings, and initially to FIGS. 1–4, an adjustable wrench in accordance with the present invention comprises a head 20 formed on one end of a tube 201. The head 20 includes an opening 21 and a V-shaped engaging surface 211 facing toward the tube 201. The tube 201 includes a bore 22 communicating with the opening 21. A block 30 is fixed in the opening 21 and close to the tube 201 and includes an inner thread 31. The inner thread may also be directly formed in the head 20 instead of being formed in the block 30. A slide 50 is slidably engaged in the opening 21 and includes a channel 51 formed in the rear portion and includes a V-shaped engaging surface 52 formed in the front portion and having a number of teeth 53 formed in the middle portion of the engaging surface 52 which faces toward the engaging surface 211. An actuating member 60 includes two V-shaped engaging surfaces 61, 62 for engaging with the surface 52 and includes a number of teeth 63 formed in the middle portion of the surface 62 for engaging with the teeth 53. A V-shaped resilient blade 70 includes two ends engaged in the cavities 54, 64 of the slide 50 and the engaging member 60 for coupling the slide 50 and the engaging member 60 together and for allowing the slide 50 and the engaging member 60 to move in concert with each other.

Figure 4:
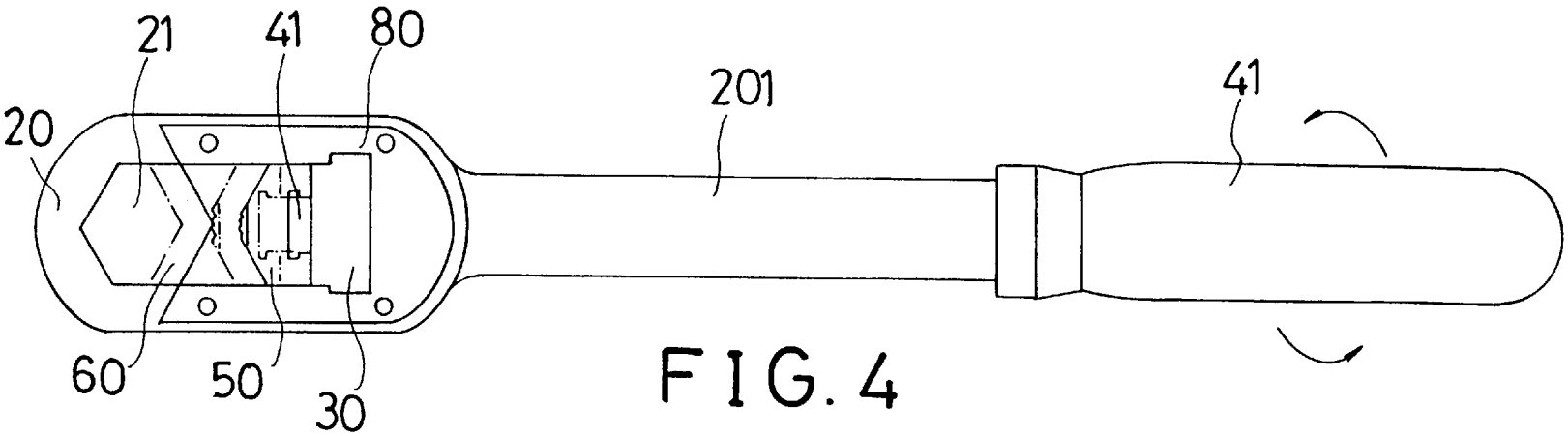
FIG. 4 is a top view illustrating the operation of the adjustable wrench.
Figure 6:
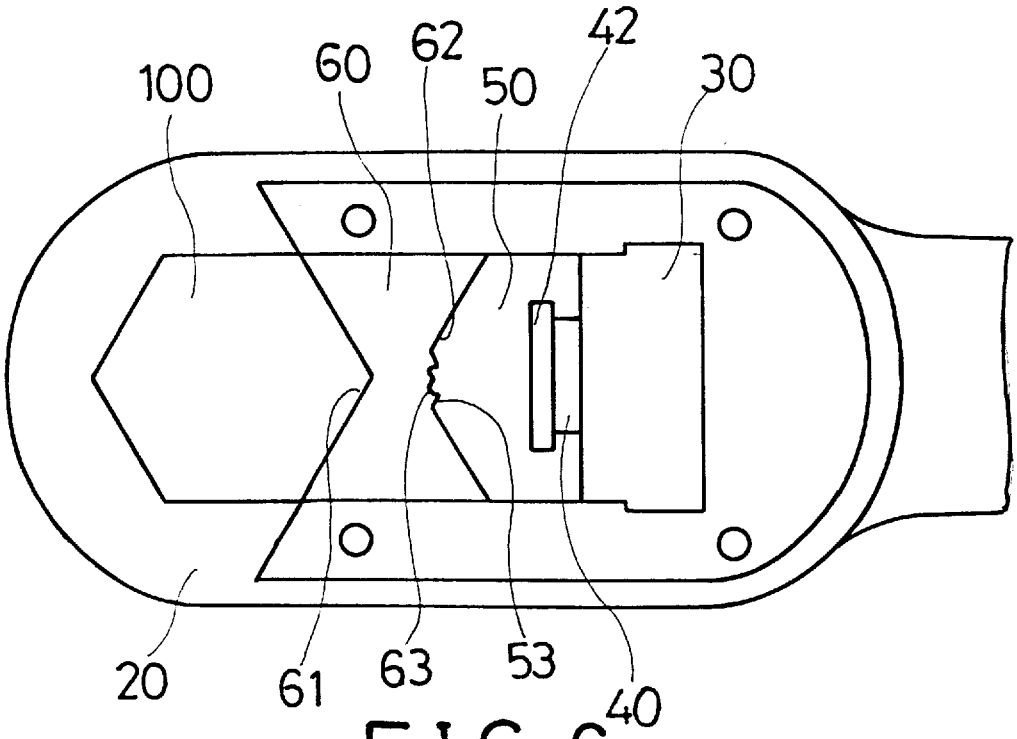
FIGS. 6 and 7 are partial top views illustrating the operation of the adjustable wrench.
Figure 7:
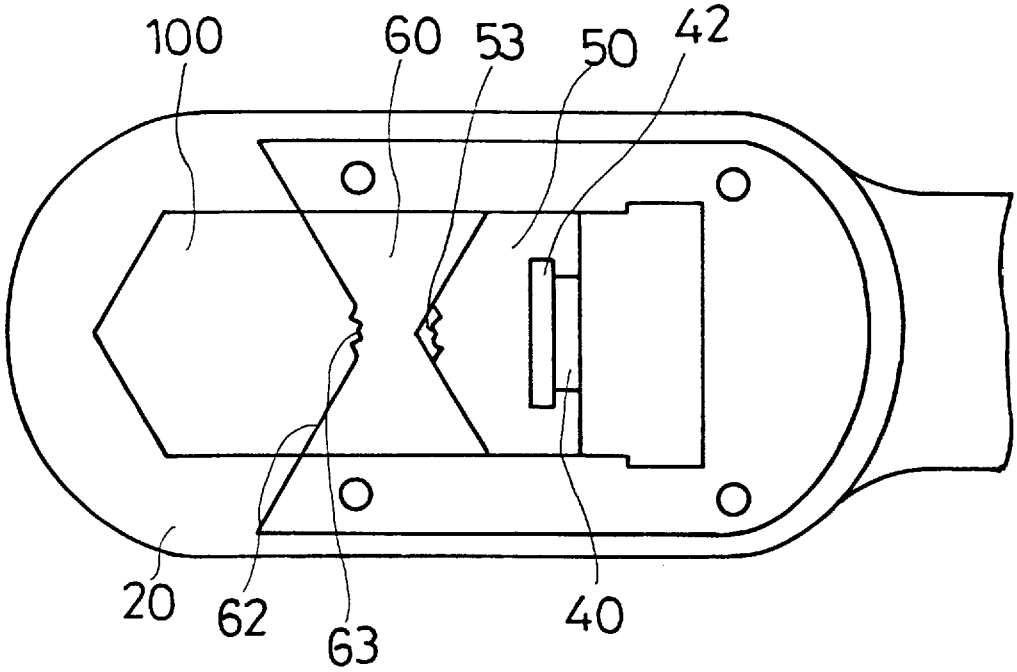

A rod 40 is rotatably and slidably engaged in the bore 22 of the tube 201 and includes an outer thread 401 formed on the front end for threadedly engaging with the inner thread 31 of the block 30. The front end of the rod 40 includes a disc 42 engaged in the channel 51 of the slide 50 for allowing the rod 40 to be rotated relative to the slide 50 and for allowing the rod 40 to move the slide 50 along the opening 21. The slide 50 and the engaging member 60 may thus be moved toward and away from the engaging surface 211 by rotating the rod 40 and for engaging with fasteners 100 of different sizes (FIGS. 4, 6, 7). The rear end of the rod 40 is extended outward of the tube 201 and a handle 41 is secured to the rear end of the rod 40 for rotating the rod 40 and for moving the engaging member 60 to engage with the fastener 100.

Figure 5:
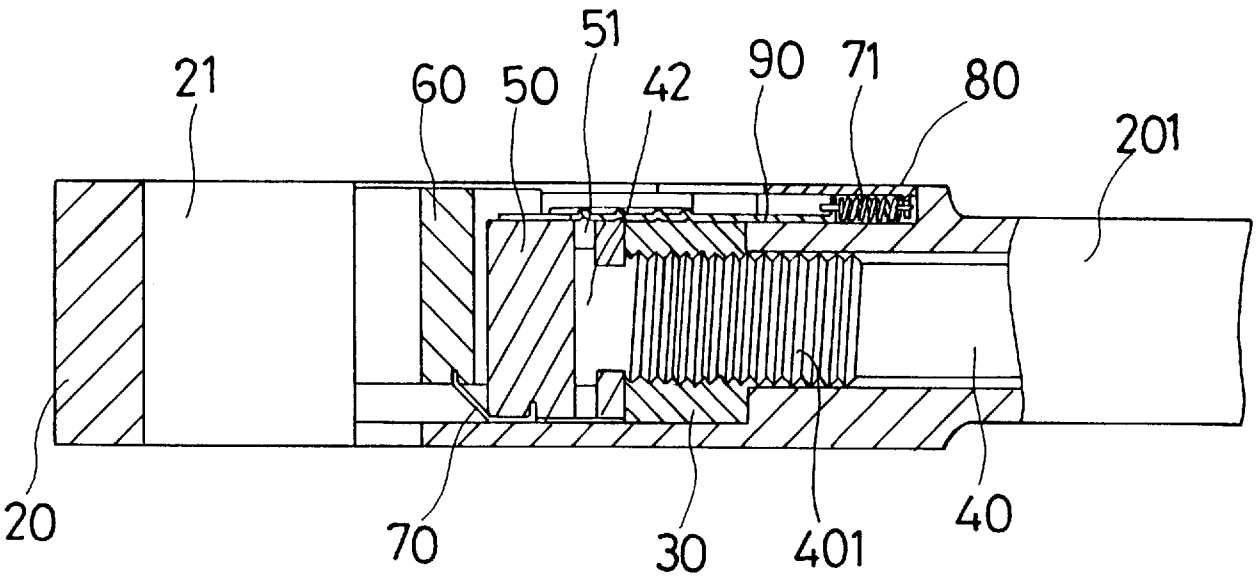
FIG. 5 is an enlarged partial cross sectional view illustrating the operation of the wrench.

A cover 80 is secured on top of one end of the head 20 and includes a recess 81 and includes a pair of tracks 82 formed in the bottom. A cap 90 includes two side flanges 91 for slidably engaging with the tracks 82 and for allowing the cap 90 to be moved inward and outward of the cover 80. An expansion spring 71 is secured between the cap 90 and the cover 80 for moving the cap 90 outward of the cover 80 to engage with the engaging member 60 (FIGS. 1, 3, 4) and for positioning the engaging member 60 in place. As shown in FIG. 5, when the cap 90 is moved inward of the cover 80 against the spring 71 until the cap 90 is disengaged from the engaging member 60, the engaging member 60 may be biased upward by the blade 70 for changing the engaging surfaces 61, 62 (FIGS. 6, 7) of the engaging member 60.

Referring next to FIG. 6, the engaging surface 61 includes a sharp corner formed in the middle portion for allowing the engaging member 60 to engage with the fastener 100 that has not been damaged. However, as shown in FIG. 7, when the corner of the fastener 100 has been damaged, it is preferable that the engaging surface 62 is facing toward and engaged with the fastener 100 for solidly engaging with and for driving the fastener 100.

Accordingly, the adjustable wrench in accordance with the present invention includes a solid structure for engaging with and for driving the fasteners. The engaging member may be adjusted to different engaging surfaces for engaging with different fasteners.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable wrench comprising:

a tube including a first end, a head provided on said first end of said tube and including an opening and including a first engaging surface for engaging with a fastener, an engaging member slidably engaged in said opening of said head and adapted to be moved toward and away from said first engaging surface of said head, said engaging member including a second engaging surface for engaging with the fastener, and said engaging member further including a fourth engaging surface, said second engaging surface and said fourth engaging surface of said engaging member being selectively provided for engaging with the fastener, and means for moving said engaging member toward the fastener for allowing said engaging member to engage with fasteners of different sizes, said moving means including a slide slidably engaged in said opening and having a third engaging surface, said moving means further including means for coupling said slide and said engaging member together, said slide and said engaging member each including a bottom portion having a cavity, said coupling means, including a V-shaped resilient blade having two ends for engaging with said cavities of said slide and said engaging member and for coupling said slide and said engaging member together.

2. The adjustable wrench according to claim 1, wherein said tube includes a bore communicating with said opening and includes a second end, said head includes an inner thread, said moving means includes a rod rotatably and slidably engaged in said bore of said tube, said rod includes a first end for engaging with said engaging member and includes an outer thread for threadedly engaging with said inner thread of said head and for allowing said rod to move said engaging member along said opening when said rod is rotated.

3. The adjustable wrench according to claim 2, wherein said rod includes a handle secured to said second end for rotating said rod and for moving said engaging member toward and away from the fastener.

4. The adjustable wrench according to claim 1, wherein said third engaging surface of said slide includes a middle portion having at least one first tooth, said fourth engaging surface of said engaging member includes a middle portion having at least one second tooth for engaging with said at least one first tooth.

5. The adjustable wrench according to claim 1, wherein said head includes a block secured in said opening and disposed close to said tube, said inner thread is formed in said block for engaging with said outer thread of said rod.

6. The adjustable wrench according to claim 1, wherein said slide includes a channel, said tube includes a bore communicating with said opening, said head includes an inner thread, said moving means includes a rod rotatably and slidably engaged in said bore of said tube, said rod includes a first end having a disc for engaging with channel and includes an outer thread for threadedly engaging with said inner thread of said head and for allowing said rod to move said engaging member along said opening when said rod is rotated.

7. An adjustable wrench comprising:

a tube including a first end, a head provided on said first end of said tube and including an opening and including a first engaging surface for engaging with a fastener, an engaging member slidably engaged in said opening of said head and adapted to be moved toward and away from said first engaging surface of said head, said engaging member including a second engaging surface and a fourth engaging surface, said second engaging surface and said fourth engaging surface of said engaging member being selectively provided for engaging with the fastener, means for moving said engaging member toward the fastener for allowing said engaging member to engage with fasteners of different sizes, said moving means including a slide slidably engaged in said opening and having a third engaging surface, said moving means further including means for coupling said slide and said engaging member together, and means for positioning said engaging member in place and for allowing said engaging member to be disengaged from said opening.

8. The adjustable wrench according to claim 6, wherein said positioning means includes a cover secured to said head and having a recess, a cap slidably engaged in said cover and adapted to be moved inward and outward of said cover, and means for biasing said cap outward of said cover to engage with said engaging member and for positioning said engaging member in place.

* * * * *